US006668740B2

(12) United States Patent
Kawamura et al.

(10) Patent No.: US 6,668,740 B2
(45) Date of Patent: Dec. 30, 2003

(54) METHOD AND APPARATUS FOR LINKING PLAIN KNITTED FABRICS

(75) Inventors: Sadao Kawamura, Kusatsu (JP); Akira Isii, Kusatsu (JP); Takahiro Wada, Takamatsu (JP); Naomasa Ochi, Nara-ken (JP); Kimio Takeda, Yamatotakada (JP)

(73) Assignee: Dan Co., Ltd., Osaka (JP)

( * ) Notice: Subject to any disclaimer, the term of this patent is extended or adjusted under 35 U.S.C. 154(b) by 75 days.

(21) Appl. No.: 10/095,087

(22) Filed: Mar. 12, 2002

(65) Prior Publication Data

US 2002/0129626 A1 Sep. 19, 2002

(30) Foreign Application Priority Data

Mar. 14, 2001 (JP) ..... 2001-072479

(51) Int. Cl.[7] ..... D05B 7/00; G06F 19/00
(52) U.S. Cl. ..... 112/475.02; 112/27; 700/141
(58) Field of Search ..... 112/475.02, 475.01, 112/25, 27; 700/141, 143, 144; 66/148

(56) References Cited

U.S. PATENT DOCUMENTS 6,263,815 B1 * 7/2001 Furudate ..... 112/470.13
6,397,121 B1 * 5/2002 Kawamura et al. ..... 700/141

* cited by examiner

*Primary Examiner*—Peter Nerbun
(74) *Attorney, Agent, or Firm*—Keating & Bennett, LLP

(57) ABSTRACT

A method for linking plain knitted fabrics includes the steps of fixing a first plain knitted fabric in a stretched state, obtaining an image including an image of a darning stitch, calculating a location of the darning stitch, repeating the above steps with a second plain knitted fabric, calculating a location of the darning stitch of the second plain knitted fabric from the obtained image, moving the first plain knitted fabric and the second plain knitted fabric relative to each other to align the darning stitches of the first and second plain knitted fabrics, moving a sewing machine needle of a sewing machine to the location of the darning stitch of the first plain knitted fabric, and linking together the darning stitches.

14 Claims, 18 Drawing Sheets

METHOD AND APPARATUS FOR LINKING PLAIN KNITTED FABRICS

BACKGROUND OF THE INVENTION

1. Field of the Invention

The present invention relates to a method and an apparatus for linking plain knitted fabrics, and more particularly, the present invention relates to a method and an apparatus for linking plain knitted fabrics, in which a darning stitch in a plain knitted fabric is automatically recognized and fabrics are accurately linked at the location of the darning stitch.

2. Description of the Prior Art

Conventionally, linking of plain knitted fabrics is performed by the following procedure. First, an operator confirms the location of the darning stitch in a first plain knitted fabric by spreading the first plain knitted fabric by his/her hands and looking through the plain knitted fabric, and sets the first plain knitted fabric on a linking apparatus by positioning the darning stitches on pointing needles of the linking apparatus, stitch by stitch. After that, a second plain knitted fabric is set on the linking apparatus such that it overlaps the first plain knitted fabric, following a similar procedure. Then the linking is performed by sewing the stitches together with a sewing machine using the pointing needles. The "darning stitch" is defined by a stitch that is slightly larger than an ordinary stitch, and with which the plain knitted fabrics are linked. Although the darning stitch is slightly larger than an ordinary stitch, the above-mentioned operation must be performed by a skilled person. To solve such problems, a method is disclosed in Japanese Patent Publication No. Hei 3-49477.

However, the efficiency of the method disclosed in Japanese Patent Publication No. Hei 3-49477 is greatly reduced, because the method includes many different process steps, including supplying two knitted fabrics to be sewn together to each of two hooking-up apparatuses which are opposed to each other on right and left sides, detecting the state in two dimensions of the array of stitches of the knitted fabric supplied to the hooking-up needle piercing apparatus, calculating location information of the stitches to be pierced, guiding with a fabric guiding device the stitches to be pierced to the piercing location, sequentially performing a piercing operation with a hooking-up needle, stitch by stitch, transferring the stitches pierced with the hooking-up needle of the hooking-up needle piercing apparatus on one side to the opposing hooking-up needle piercing apparatus, and linking together the opposing stitches of the two fabrics with a sewing apparatus. Efficiency further deteriorates when changing the type of fabric to be linked, because the rolling drum of the hooking-up needle piercing apparatus must be changed to one having a slit which conforms to the pitch of the fabric. Additionally, the method disclosed in Japanese Patent Publication No. Hei 3-49477 required a large space.

SUMMARY OF THE INVENTION

In order to overcome the above-described problems, preferred embodiments of the present invention provide a method,and an apparatus for linking plain knitted fabrics, which requires a greatly reduced amount of space, and which enables accurate and efficient linking of fabrics, regardless of the type of plain knitted fabric.

A preferred embodiment of the present invention provides a method for linking plain knitted fabrics including the steps of fixing a first plain knitted fabric in a stretched state, obtaining an image including an image of a darning stitch of the first plain knitted fabric in the stretched state, calculating a location of the darning stitch of the first plain knitted fabric from the obtained image, holding a second plain knitted fabric in a stretched state, obtaining an image including an image of a darning stitch of the second plain knitted fabric in the stretched state, calculating a location of the darning stitch of the second plain knitted fabric to be correspondingly linked to the first plain knitted fabric from the obtained image, moving the first plain knitted fabric and the second plain knitted fabric relative to each other such that the location of the darning stitch of the second plain knitted fabric and the location of the darning stitch of the first plain knitted fabric are aligned with each other, moving a sewing, machine needle of a sewing machine mechanism to the location of the darning stitch of the first plain knitted fabric, and linking together the darning stitch of the first plain knitted fabric and the darning stitch of the second plain knitted fabric with the sewing machine needle. In this case, linking is performed accurately at the location of the darning stitches, after the darning stitches have been recognized accurately.

Preferably, in the step of obtaining the image including the image of the darning stitch of the first plain knitted fabric, an image including a plurality of darning stitches of the first plain knitted fabric is obtained, and in the step of calculating the location of the darning stitch of the first plain knitted fabric from the obtained image, locations of the plurality of darning stitches of the first plain knitted fabric that have been picked up are calculated. In this case, the locations of the darning stitches of the first plain knitted fabric can be calculated from a small number of image-pickups.

Preferably, in the step of obtaining the image including the image of the darning stitch of the first plain knitted fabric, the image including a plurality of darning stitches of the first plain knitted fabric is obtained while moving an image pick-up mechanism. In this case, the precision of the calculation of the locations of the darning stitches is greatly improved, and the image-obtaining time is reduced, by obtaining an enlarged image of the darning stitches of the first plain knitted fabric.

Preferably, the method includes the step of moving the sewing machine needle of the sewing machine mechanism by one stitch of the darning stitch in a direction in which the darning stitches are provided in a row, and the following steps are performed repeatedly: obtaining the image including the image of the darning stitch of the second plain knitted fabric, calculating the location of the darning stitch of the second plain knitted fabric from the obtained image, moving the second plain knitted fabric to bring the location of the darning stitch of the second plain knitted fabric and the location of the darning stitch of the first plain knitted fabric to be aligned with each other, moving a sewing machine needle of a sewing machine mechanism to the location of the darning stitch of the first plain knitted fabric, linking together the darning stitch of the first plain knitted fabric and the darning stitch of the second plain knitted fabric with the sewing machine needle, and moving the sewing machine needle of the sewing machine mechanism by one stitch of the darning stitch in the direction in which the darning stitches are provided in a row. In this case, linking is performed accurately at the locations of a plurality of darning stitches to be linked, after the darning stitches have been recognized accurately.

Preferably, in the step of moving the sewing machine needle of the sewing machine mechanism by one stitch of the darning stitch in the direction in which the darning stitches are provided in a row, the sewing machine needle is moved to a location where the darning stitch of the first plain knitted fabric is actually located, based on data calculated in the step of calculating the location of the darning stitch of the first plain knitted fabric. In this case, a linking operation is easily performed, by moving the darning stitch of the second plain knitted fabric and the location of the darning stitch of the first plain knitted fabric into alignment.

The step of calculating the location of the darning stitch of the first plain knitted fabric from the obtained image and the step of calculating the location of the darning stitch of the second plain knitted fabric from the obtained image preferably include the step of detecting a darning stitch to be linked first.

The step of detecting the darning stitch to be linked first preferably includes the steps of detecting a darning stitch or a lower stitch in a portion where the darning stitches are orderly arranged, detecting darning stitches in sequence in a direction toward the darning stitch to be linked first relative to the location of the detected darning stitch or lower stitch, and determining whether or not the detected darning stitch is the darning stitch to be linked first.

Another preferred embodiment of the present invention provides an apparatus for linking plain knitted fabrics including a fixing device for fixing a first plain knitted fabric in a stretched state, a first image obtaining device for obtaining an image including an image of a darning stitch of the first plain knitted fabric in the stretched state, a holding fixture for holding a second plain knitted fabric in a stretched state, a second image obtaining device for obtaining an image including an image of a darning stitch of the second plain knitted fabric in the stretched state, an image processing system for calculating a location of the darning stitch of the first plain knitted fabric and a location of the darning stitch of the second plain knitted fabric from the images obtained by the first image obtaining device and the second image obtaining device, a controller for locating the holding fixture, which controls the holding fixture such that the location of the darning stitch of the second plain knitted fabric to be correspondingly linked to is moved into alignment with the location of the darning stitch of the first plain knitted fabric to be linked with, and a sewing machine mechanism provided with the controller for locating a sewing machine needle, which controls the sewing machine needle to move to the location of the darning stitch of the first plain knitted fabric to be linked with. In this case, linking is performed accurately at the location of the darning stitch to be linked, after the darning stitch has been accurately recognized.

The first image obtaining device for obtaining the image including the image of the darning stitch of the first plain knitted fabric preferably picks up an image of a plurality of darning stitches of the first plain knitted fabric, and the image processing system for calculating the location of the darning stitch of the first plain knitted fabric to be correspondingly linked to from the obtained image preferably calculates the locations of the plurality of darning stitches of the first plain knitted fabric. In this case, the locations of the darning stitches of the first plain knitted fabric are calculated from a small number of obtained images.

The apparatus further includes a moving mechanism for moving the first image obtaining device, and the first image obtaining device for obtaining the image including the image of the darning stitch of the first plain knitted fabric picks up the image including the image of the plurality of darning stitches of the first plain knitted fabric, while being moved by the moving mechanism. In this case, the precision of the calculation of the locations of the darning stitches is greatly improved, and the image-pickup time is reduced by obtaining an enlarged image of the darning stitches of the first plain knitted fabric.

The controller for locating the sewing machine needle controls the sewing machine needle to move to the location of the darning stitch of the first plain knitted fabric to be linked next, after completing a linking of one stitch of the darning stitches. In this case, linking is performed accurately at the locations of the plurality of darning stitches to be linked, after the darning stitches have been accurately recognized.

The second image obtaining device preferably moves along with the movement of the sewing machine needle. In this case, the second image obtaining device always picks up images from directly above the darning stitch that is to be linked.

The foregoing and other elements, steps, characteristics, features and advantages of this invention will become more apparent from the following detailed description of preferred embodiments thereof with reference to the attached drawings.

BRIEF DESCRIPTION OF THE DRAWINGS

FIG. 9 is an illustration showing a sewing machine needle being moved to the location of the darning stitch of the first plain knitted fabric to be linked with.

DETAILED DESCRIPTION OF PREFERRED EMBODIMENTS

Figure 1:
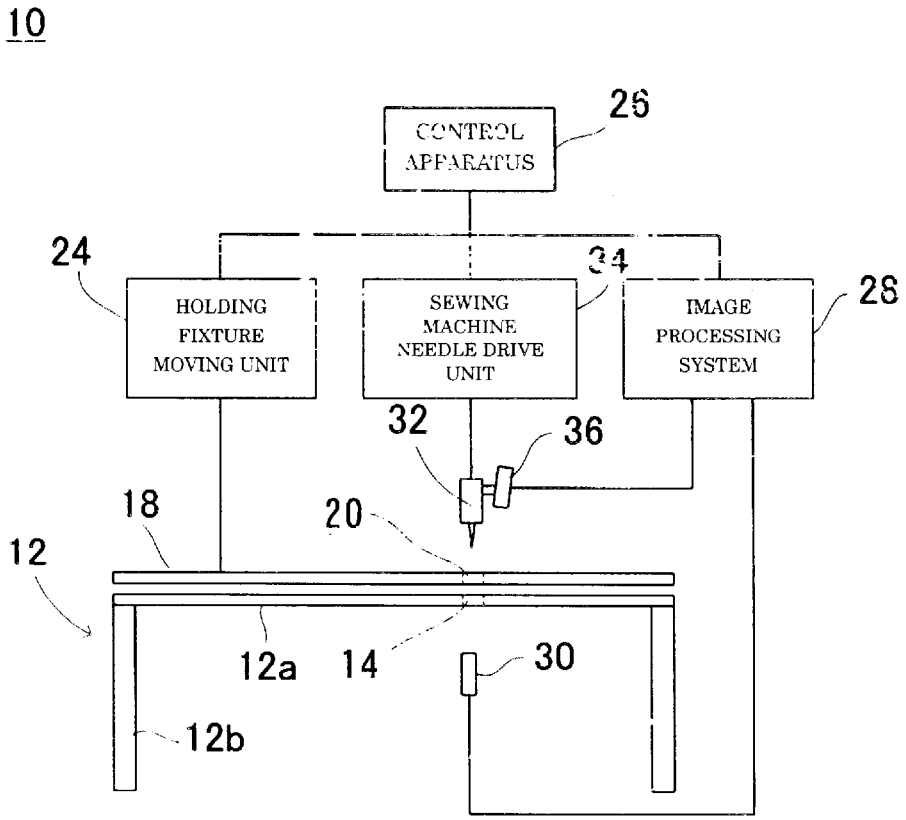
FIG. 1 is a schematic view of a preferred embodiment of a linking apparatus for plain knitted fabrics according to the present invention.
Figure 2:
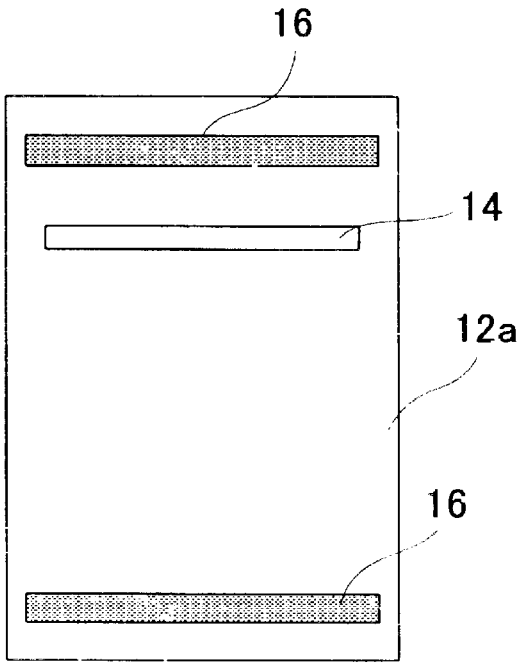
FIG. 2 is an illustrated plan view showing a top plate.

FIG. 1 is a schematic view of an apparatus for linking plain knitted fabrics according to a preferred embodiment of the present invention. The apparatus for linking plain knitted fabrics 10 includes a table 12. The table 12 includes a top plate 12*a* and legs 12*b*, and is adapted for mounting and placing a first plain knitted fabric,that is going to be linked. As shown in FIG. 2, the shape of the top plate 12*a* is substantially planar and substantially rectangular including a flat surface, and is configured such that the first plain knitted fabric is mounted in a flat state thereon. A slit 14 is provided on one portion of the top plate 12*a*. The slit 14 is used to thrust the sewing machine needle 32, which is described below, through darning stitches of the first plain knitted fabric and of a second plain knitted fabric, when linking the first plain knitted fabric and the second plain knitted fabric. The slit 14 is substantially rectangular and elongated, and penetrates the top plate 12*a*.

A male surface fastener 16 is installed on both ends in the longitudinal direction of the top plate 12*a*, as shown in FIG. 2. The male surface fastener 16 detachably attaches the first plain knitted fabric in a stretched state on top of the top plate 12*a*. The male surface fastener 16 has sufficient fastening strength such that the plain knitted fabric is not damaged when attaching and detaching the plain knitted fabric.

Figure 3:
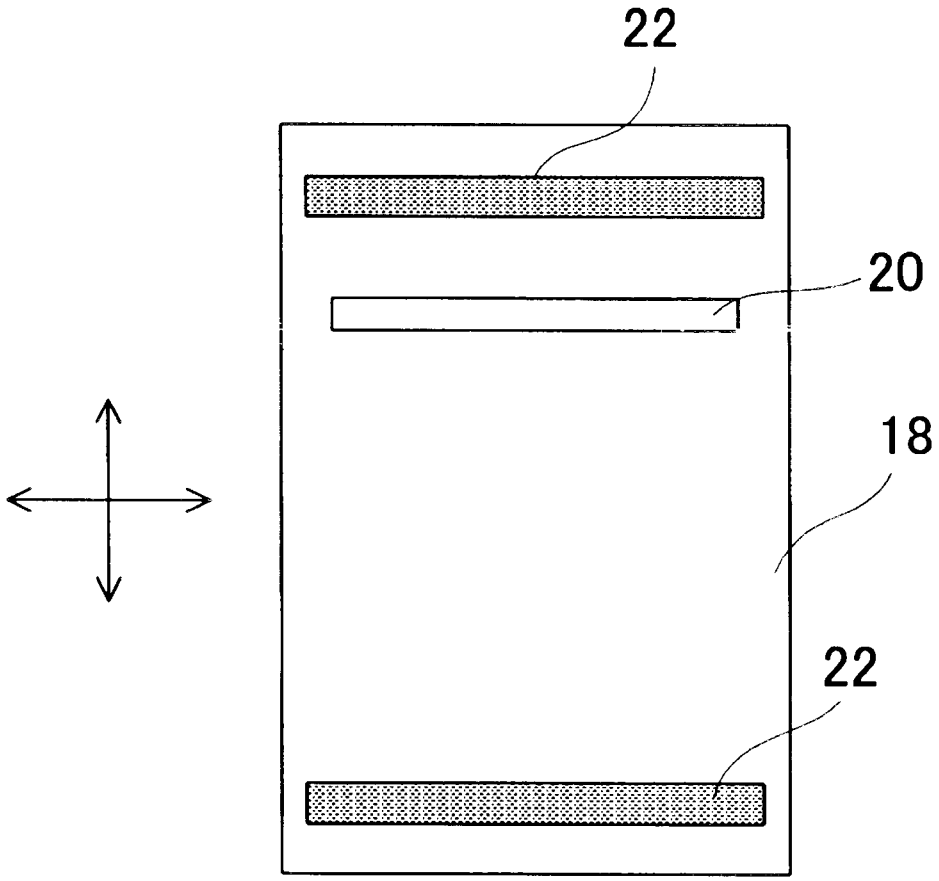
FIG. 3 is an illustrated plan view showing a holding fixture.

A holding fixture 18 is provided and supported in a movable state by a holding fixture moving unit 24, which is described hereinafter, on the top of the table 12. The holding fixture 18 holds the second plain knitted fabric, which is to be linked to the first plain knitted fabric, in a stretched state. As shown in FIG. 3, the holding fixture 18 is substantially planar and substantially rectangular and includes a thin plate member having a flat surface, and is configured such that the second plain knitted fabric is held substantially flat. A slit 20 is provided on a portion of the holding fixture 18. The slit 20 is used to thrust the sewing machine needle 32 through the darning stitches of the second plain knitted fabric, when linking the second plain knitted fabric and the first plain knitted fabric together. The slit 20 has a shape similar to the slit 14, and the shape thereof is substantially rectangular and elongated. The slit 20 penetrates the holding fixture 18. Since it is preferable that the first plain knitted fabric and the second plain knitted fabric be located as near as possible to each other during the linking operation, it is preferred that the thickness of the holding fixture 18 is as thin as possible.

A male surface fastener 22 is provided on both ends in the longitudinal direction of the holding fixture 18, as shown in FIG. 3. The male surface fastener 22 detachably attaches the second plain knitted fabric in a stretched state on the top surface of the holding fixture 18. The male surface fastener 22 has sufficient fastening strength such that the plain knitted fabric is not damaged when attaching and detaching the plain knitted fabric.

The holding fixture 18 is provided on the holding fixture moving unit 24, as mentioned above. The holding fixture moving unit 24 moves the holding fixture 18 freely in directions that are substantially parallel to the surface of the top plate 12*a*, as shown in FIG. 3. A combination of plural conveyors and/or feed screws with motors attached thereto is provided to move the holding fixture moving unit 24.

A control apparatus 26 is connected to the holding fixture moving unit 24. The control apparatus 26 controls the actions of the holding fixture moving unit 24 and of a sewing machine needle drive unit 34 described later. The control apparatus 26 controls the actions of each of the units, based on the location data of the darning stitch of the plain knitted fabric which is input by various computers.

An image processing system 28 is connected to the control apparatus 26. The image processing system 28 calculates the locations of all of the darning stitches of the first plain knitted fabric, from a multiple tone image including an image of all of the darning stitches of the first plain knitted fabric picked up by a camera 30. The camera 30 defines the first image obtaining device installed in the vicinity of the slit 14, at the backside of the top plate 12*a*. The location data of all of the darning stitches of the plain knitted fabric calculated by the image processing system 28 is sent to the control apparatus 26, and is used as the data for moving the holding fixture 18.

For the image processing system 28, the image processing system disclosed in Japanese Patent Laid-Open Publications No. Hei 11-207061 or No. Hei 11-207062 may be used, and the location of the darning stitch of the plain knitted fabric is calculated by a method similar to those disclosed in these publications.

A sewing machine needle 32 is provided above the slit 20 of the holding fixture 18. The sewing machine needle 32 is used to link the second plain knitted fabric and the first plain knitted fabric, by providing a thread through the darning stitches of those fabrics.

The sewing machine needle 32 is provided on the sewing machine needle drive unit 34. The sewing machine needle drive unit 34 moves the sewing machine needle 32 in directions that are substantially parallel to the surface of the top plate 12*a*, such that the sewing machine needle 32 is located directly above the darning stitch. The sewing machine needle drive unit 34 further moves the sewing machine needle 32 vertically to link the plain knitted fabrics.

A camera 36 defining the second image obtaining device is provided on the sewing machine needle 32. The camera 36 picks up a multiple tone image of the darning stitch of the second plain knitted fabric, which is held by the holding fixture 18. In this preferred embodiment, the camera 36 is arranged such that an image of only one darning stitch which is located almost directly below the sewing machine needle 32 is picked up, instead of obtaining an image of all of the darning stitches of the second plain knitted fabric.

The camera 36 is connected to the above-mentioned image processing system 28. The image processing system 28 calculates the location of the darning stitch of the second plain knitted fabric by a method similar to the method by which the multiple tone image picked up by the camera 30 is processed. The location data of the darning stitch of the second plain knitted fabric that is calculated by the image processing system 28, is sent to the control apparatus 26, and is used as the data for moving the sewing machine needle 32 in directions that are substantially parallel to the top plate 12*a*.

Figure 4:
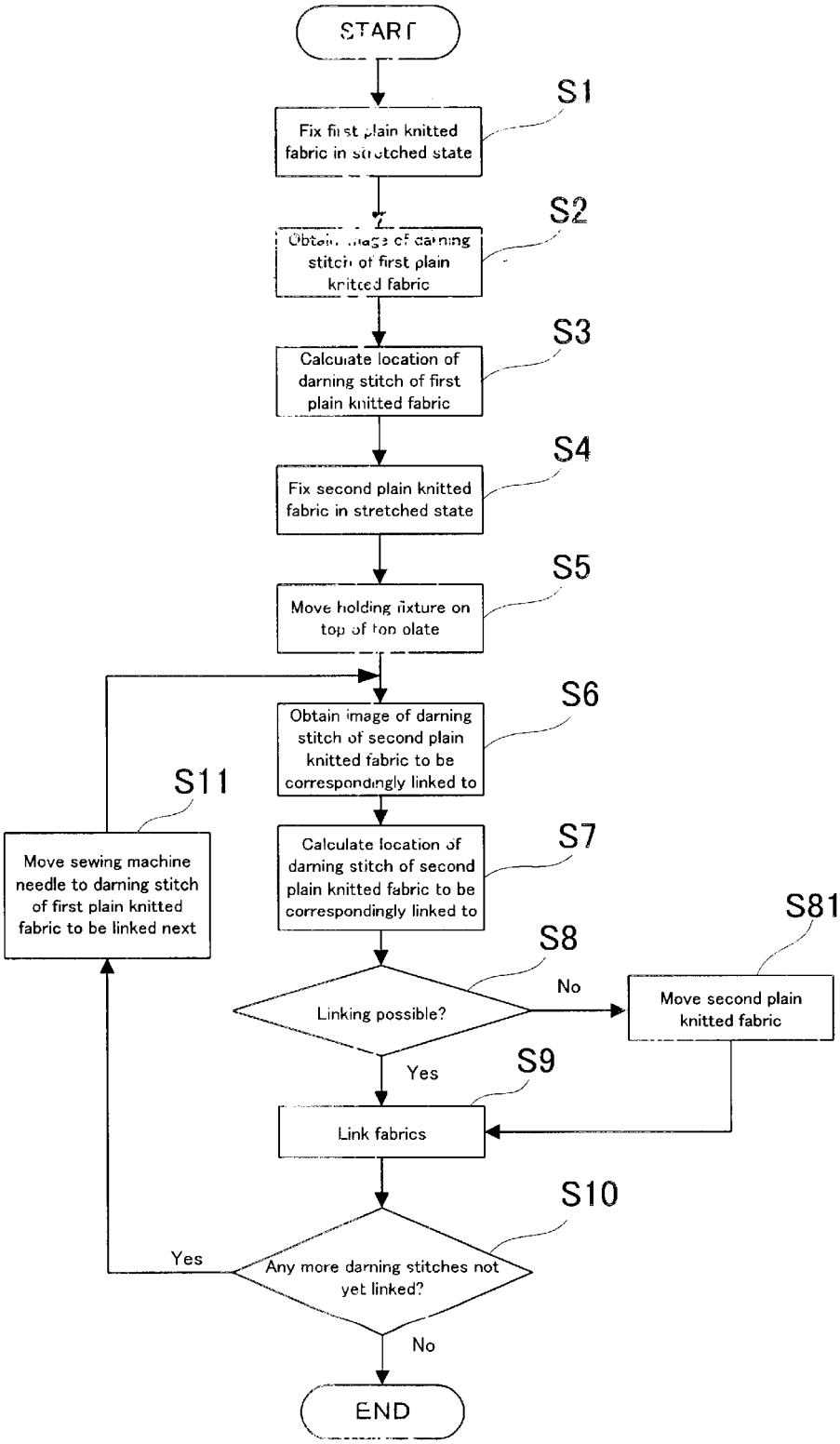
FIG. 4 is a flowchart showing the flow of operations in this preferred embodiment of the present invention.

The operations in this preferred embodiment will be described next. FIG. 4 is a flowchart showing the flow of operations in this preferred embodiment.

Figure 5:
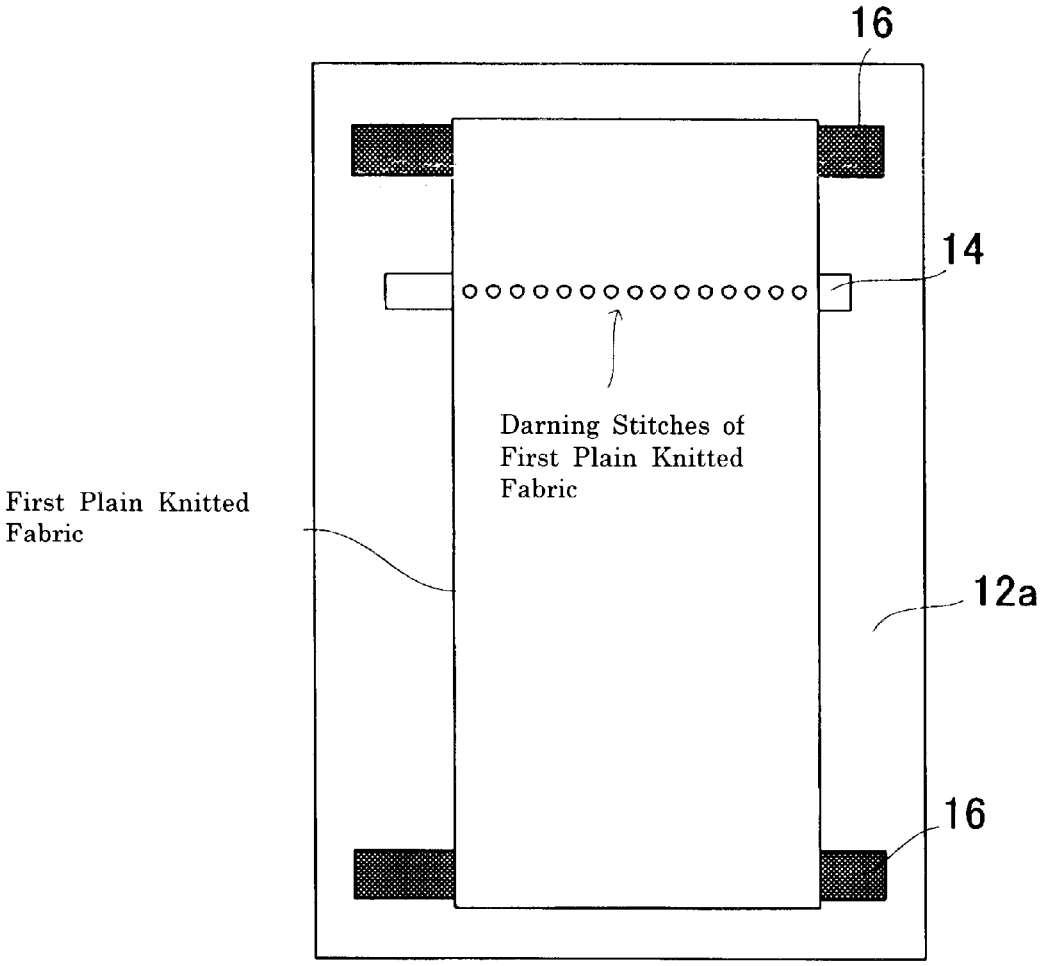
FIG. 5 is an illustration showing a first plain knitted fabric being fixed to the top plate.

In step S1, the first plain knitted fabric is attached and fixed to the male surface fastener 16 in a stretched state on top of the top plate 12*a*, as shown in FIG. 5. Here, the first plain knitted fabric is fixed such that all of the darning stitches are located above the slit 14, as shown in FIG. 5.

Then, in step S2, a multiple tone image including an image of all of the darning stitches of the first plain knitted fabric arranged above the slit 14 is picked up by the camera 30. The camera 30 preferably picks up the image utilizing a light that transmits the first plain knitted fabric, such that the boundaries between the stitch area including the darning stitch and the fiber area is clearly distinguished. In order to achieve the above-mentioned lighting environment, the first plain knitted fabric is arranged between the camera 30 and a light source which is not shown. It is also preferable that the lighting is uniformly provided, such that brightness does not vary according to the obtained regions.

In step S3, the multiple tone image picked up by the camera 30 is sent to the image processing system 28, and the locations of all of the darning stitches of the first plain knitted fabric are calculated. The calculation of the location of the darning stitch is performed with respect to each of the darning stitches, by determining a random point on the top plate 12*a* as a reference point and by calculating a relative distance from the reference point. However, the calculation of the location of the darning stitch is not limited to the above-mentioned method, and can be performed by calculating a relative distance from the reference point with respect to only one random darning stitch, e.g. either of the darning stitches provided at the endmost positions, and with respect to the other darning stitches, by calculating a relative distance from an adjacent darning stitch in reference to the random darning stitch with which the relative distance from the reference point has been calculated.

The location data of the darning stitch of the first plain knitted fabric calculated by the image processing system 28 is sent to the control apparatus 26. The location data sent to the control apparatus 26 is used as the data for moving the holding fixture 18, as mentioned above.

Figure 6:
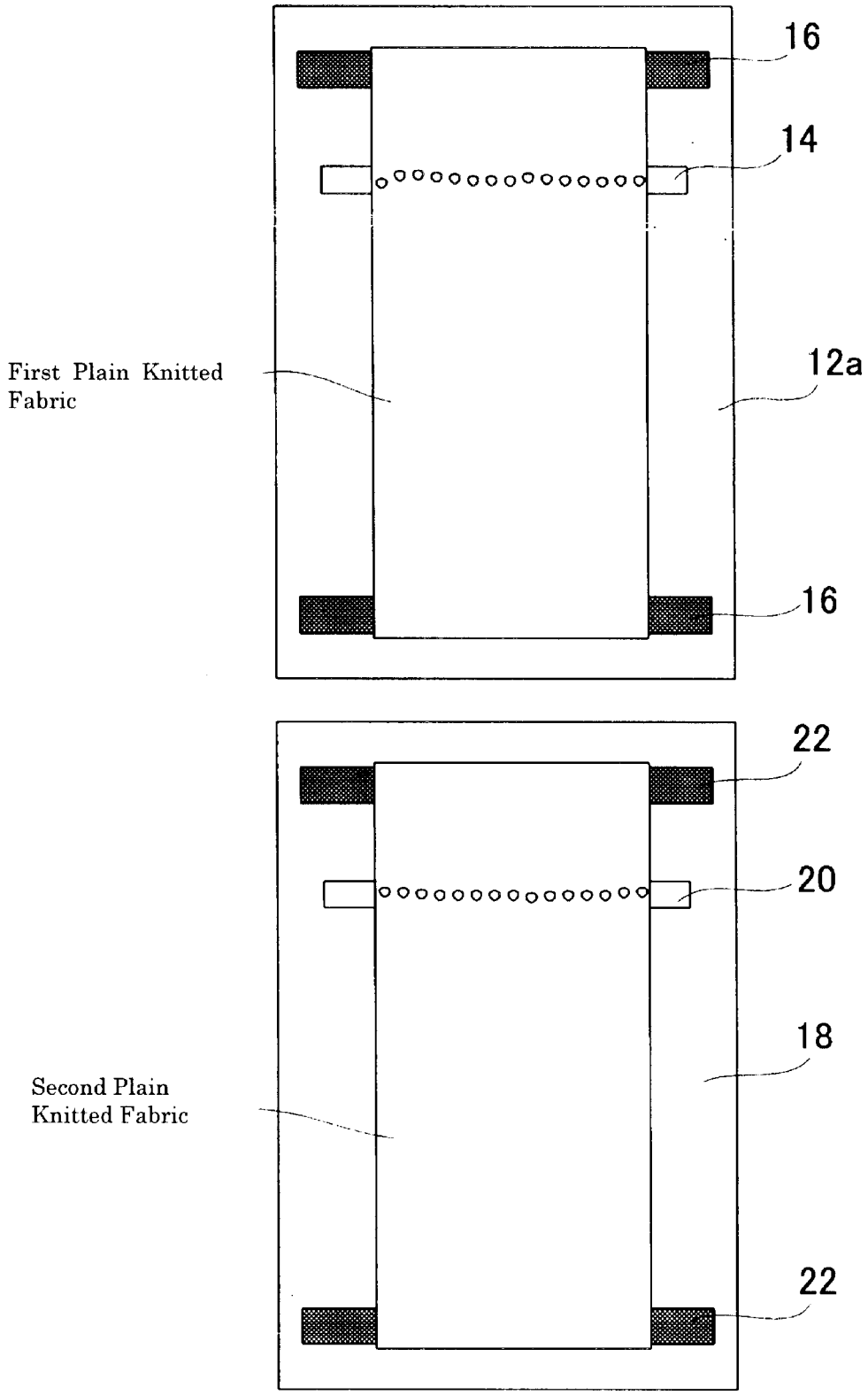
FIG. 6 is an illustration of a plan view showing the first plain knitted fabric and a second plain knitted fabric being mounted.

Next, in step S4, the male surface fastener 22 on the holding fixture 18 is attached with the second plain knitted fabric thereon, and holds the second plain knitted fabric in a stretched state. The second plain knitted fabric is held and fixed such that all of the darning stitches are located above the slit 20, as in the case of the first plain knitted fabric. At this point, the holding fixture 18 is not located directly above the top plate 12*a*, as shown in FIG. 6, but is positioned at a location spaced from the location directly above the top plate 12*a*, such that the above-mentioned fixing operation of the first plain knitted fabric is easily performed.

Figure 7:
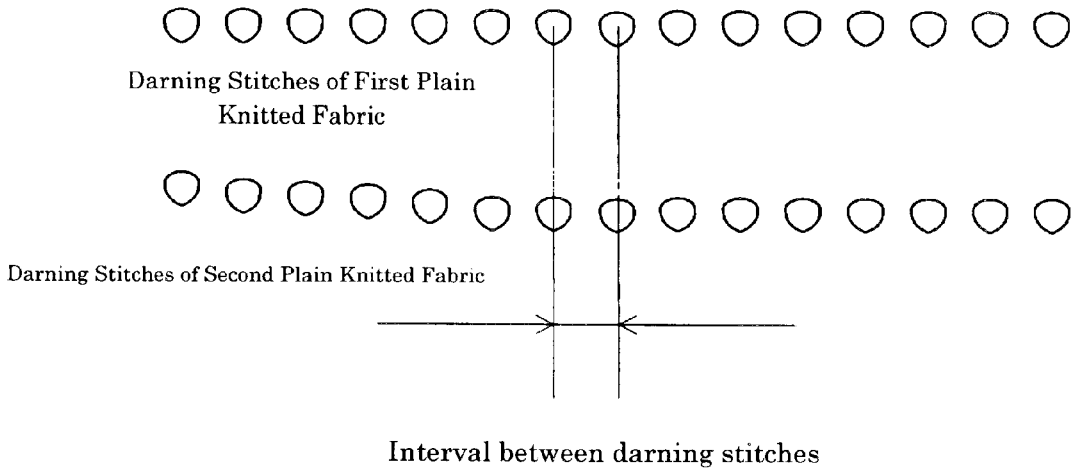
FIG. 7 is a schematic view describing a darning stitch of the first plain knitted fabric and a darning stitch of the second plain knitted fabric.

After finishing the above-mentioned steps, the intervals between the darning stitches in the first plain knitted fabric and the darning stitches in the second plain knitted fabric are preferably arranged to be substantially the same, as shown in FIG. 7. This is easily performed by first confirming beforehand the locations where the intervals between the darning stitches in the first plain knitted fabric and the darning stitches in the second plain knitted fabric are the same, and then providing marks indicating locations where the plain knitted fabrics are to be attached onto the male surface fastener 16 and onto the male surface fastener 22. However, it is not essential to perform an accurate alignment of the locations, because the linking apparatus of plain knitted fabrics according to preferred embodiments of the present invention adjusts by moving the darning stitch to a location where the linking operation is performed when there are deviations between the locations or intervals of the darning stitches in the first plain knitted fabric and the darning stitches in the second plain knitted fabric.

Figure 8:
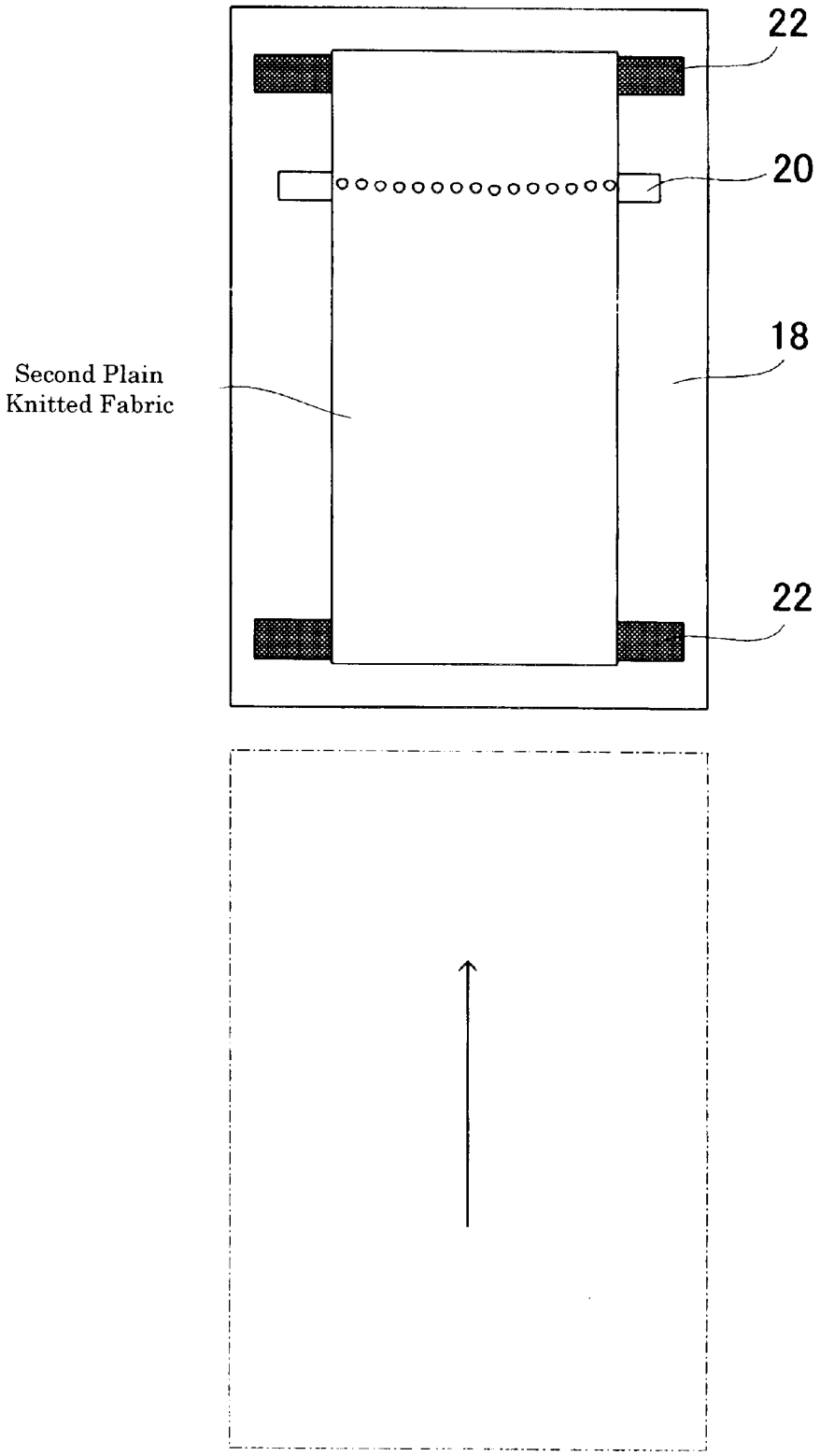
FIG. 8 is an illustration showing the holding fixture being moved to a place above the top plate.

In step S5, the holding fixture moving unit 24 is driven by the control apparatus 26, and the holding fixture 18 is moved to a reference location above the top plate 12*a*, as shown in FIG. 8. In this preferred embodiment, the reference location is defined by the location where the holding fixture 18 is located directly above the top plate 12*a*. When moving the holding fixture 18 above the top plate 12*a*, the holding fixture 18 and the first plain knitted fabric are not substantially in contact with each other, because the first plain knitted fabric is likely to deform due to the friction force caused between the holding fixture 18, thereby the location of the darning stitch could be altered.

Figure 9:
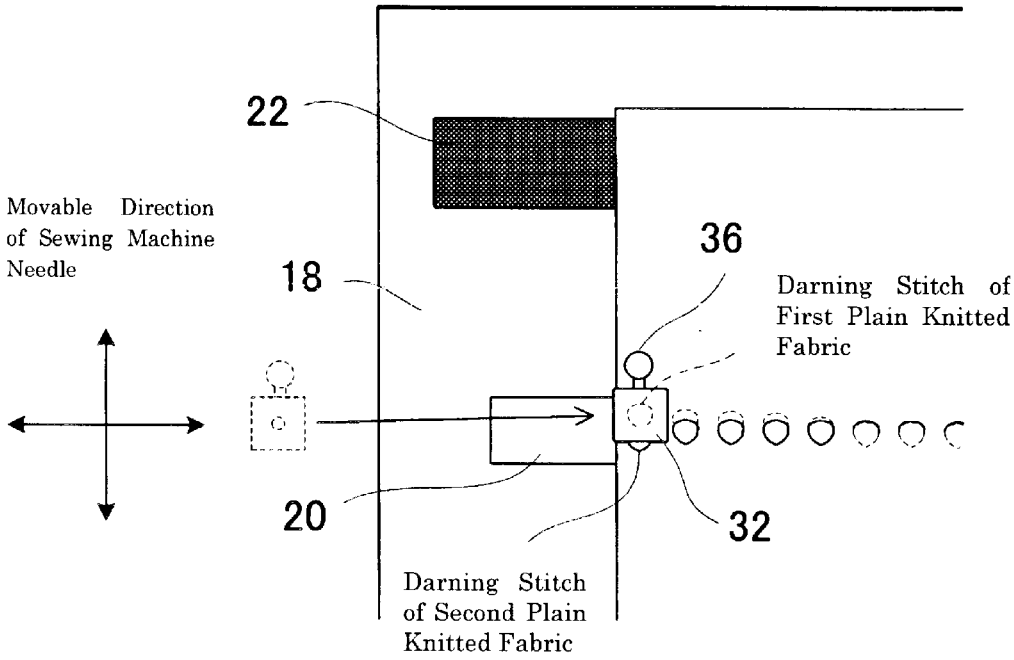

Then, in step S6, a multiple tone image including an image of the darning stitch to be linked first, in other words the darning stitch located at the endmost position on one end side of the second plain knitted fabric, is obtained by the camera 36. The sewing machine needle 32 is controlled by the control apparatus 26 such that it is located above the place where the darning stitch at the endmost position on one end side of the first plain knitted fabric is located, based on the location of the darning stitch of the first plain knitted fabric calculated in step S3, as shown in FIG. 9.

When obtaining an image, the camera 36 preferably obtains the image utilizing light that is emitted through the second plain knitted fabric, such that the boundaries between the stitch area including the darning stitch and the fiber area are clearly distinguished, as in the obtaining of the image in the first plain knitted fabric.

In step S7, the multiple tone image obtained by the camera 36 is sent to the image processing system 28, and the location of the darning stitch located at the endmost position on one end side of the second plain knitted fabric is calculated. The location of the darning stitch of the plain knitted fabric is calculated by a method similar to the image processing disclosed in Japanese Patent Laid-Open Publication No. Hei 11-207061 or No. Hei 11-207062.

The location data of the darning stitch at the endmost portion on one end side of the second plain knitted fabric calculated by the image processing system 28 is sent to the control apparatus 26. The location data sent to the control apparatus 26 is used by the control apparatus 26 to move the holding fixture 18.

In step S8, the control apparatus 26 determines whether or not the linking operation can be performed in reference to the location of the darning stitch located at the endmost position on one end side of the second plain knitted fabric and the location of the corresponding darning stitch of the first plain knitted fabric.

Figure 10:
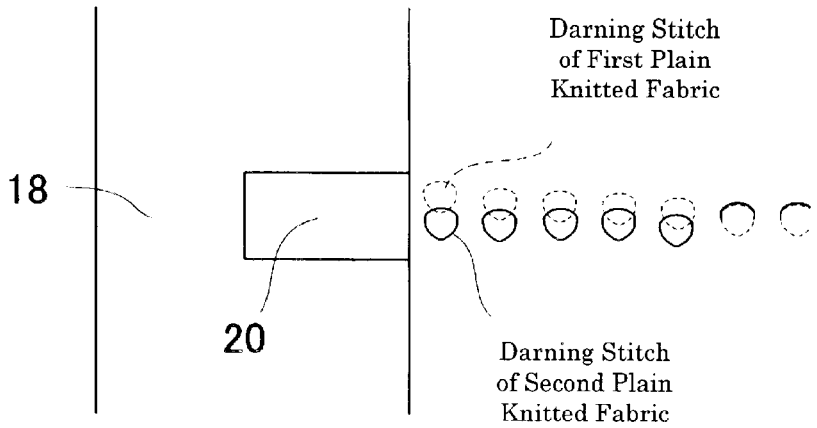
FIG. 10 is an illustration showing a state where the darning stitches of the first plain knitted fabric and the corresponding darning stitches of the second plain knitted fabric are located at a position where they cannot be linked together.
Figure 11:
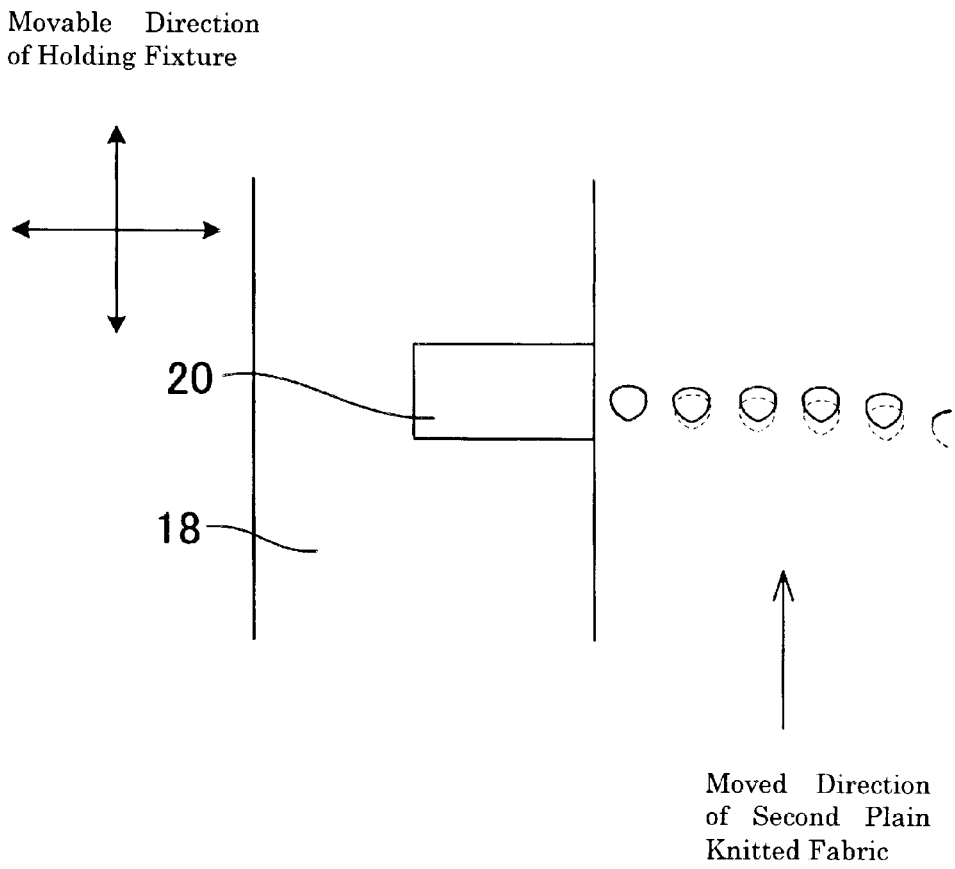
FIG. 11 is an illustration showing a state where the darning stitch of the second plain knitted fabric is moved to a position where it can be linked to the corresponding darning stitch of the first plain knitted fabric.

When the darning stitch of the first plain knitted fabric and the corresponding darning stitch of the second plain knitted fabric are located such that the linking operation is not possible, as shown in FIG. 10, the process advances to step S81. In step S81, as shown in FIG. 11, the control apparatus 26 moves the holding fixture 18 to move the darning stitch of the second plain knitted fabric such that it can be linked to the corresponding darning stitch of the first plain knitted fabric, i.e. to a place where the darning stitch of the first plain knitted fabric is located directly below the darning stitch of the second plain knitted fabric.

When the holding fixture 18 is moved such that the darning stitch of the first plain knitted fabric and the corresponding darning stitch of the second plain knitted fabric are located such that the linking operation can be performed, a linking operation is performed in step S9.

When the darning stitch of the first plain knitted fabric and the corresponding darning stitch of the second plain knitted fabric are located such that the linking operation can be performed without moving the holding fixture 18, the linking operation is performed in step S9, skipping step S81.

In step S10, the control apparatus 26 determines whether or not a darning stitch that is yet linked is present. The control apparatus 26 determines whether or not a darning stitch not yet linked is present, for example, on the basis of preliminary storing of the number of darning stitches provided in the plain knitted fabric in the holding fixture moving unit 24 and counting of the number of times step S8 has been performed.

When the linking operation has not been performed for all of the darning stitches, the sewing machine needle 32 is moved by the control apparatus 26 to the location of the darning stitch of the first plain knitted fabric to be linked next. That is, the sewing machine needle 32 is moved in the direction in which the darning stitches are provided in a row.

After the sewing machine needle 32 has been moved, the process resumes again from step S6. Processes from steps S6 through S11 are repeated for a number of times equal to the number of darning stitches formed into the plain knitted fabric, and the linking operation is completed.

In this preferred embodiment, the male surface fastener 16 and the male surface fastener 22 are provided only at the end portion in the longitudinal direction of the top plate 12*a* and the holding fixture 18. However, the male surface fasteners may be provided in other portions as well. When the darning stitch of the first plain knitted fabric moves during the linking operation, the male surface fasteners 16 and 22 are preferably provided at the periphery of the slit 14 and the slit 20.

In this preferred embodiment, the male surface fastener 16 and the male surface fastener 22 are provided on the top plate 12*a* and on the holding fixture 18, and the first plain knitted fabric and the second plain knitted fabric are fixed to these fasteners. However, the plain knitted fabrics may be fixed by clamping device such as a clip or a clamp.

In this preferred embodiment, during the process of moving the darning stitch of the second plain knitted fabric to a location where the darning stitch of the second plain knitted fabric can be linked with the corresponding darning stitch of the first plain knitted fabric, it is moved without recognizing the mutual relation of their locations during the movement. Alternatively, the location of the darning stitch of the second plain knitted fabric may be detected by obtaining an image thereof, even during the process of moving the darning stitch of the second plain knitted fabric, and the darning stitch of the second plain knitted fabric may be moved based on the ever-changing mutual relation of their locations during this moving process.

In this preferred embodiment, the camera 30 is preferably provided at the backside of the top plate 12*a*. Alternatively, the camera 30 may be provided in any location such that it can pick up an image of all of the darning stitches of the first plain knitted fabric.

In this preferred embodiment, the camera 36 is provided on the sewing machine needle 32 to pick up an image of the darning stitch directly below the sewing machine needle 32. However, the camera 36 may be movably provided at a location where it can pick up an image of the darning stitches of the second plain knitted fabric, and the movement of the camera may be controlled by the control apparatus 26.

In this preferred embodiment, the camera 36 picks up an image of only the darning stitch directly below the sewing machine needle 32. In other words, the camera 36 picks up an image of only the darning stitch of the second plain knitted fabric about to be linked. However, the camera may be provided such that an image of a portion of or all of the darning stitches of the second plain knitted fabric is picked up, from which only the location of the darning stitch about to be linked is calculated.

In this preferred embodiment, two cameras are preferably provided to obtain images of the darning stitches of the plain knitted fabric. Alternatively, images of the darning stitches may be obtained using only one camera. In this case, the obtained image may be stored in memory after obtaining an image of the darning stitch of the first plain knitted fabric, or the location of the darning stitch of the first plain knitted fabric calculated from the obtained image may be stored in memory.

Figure 12:
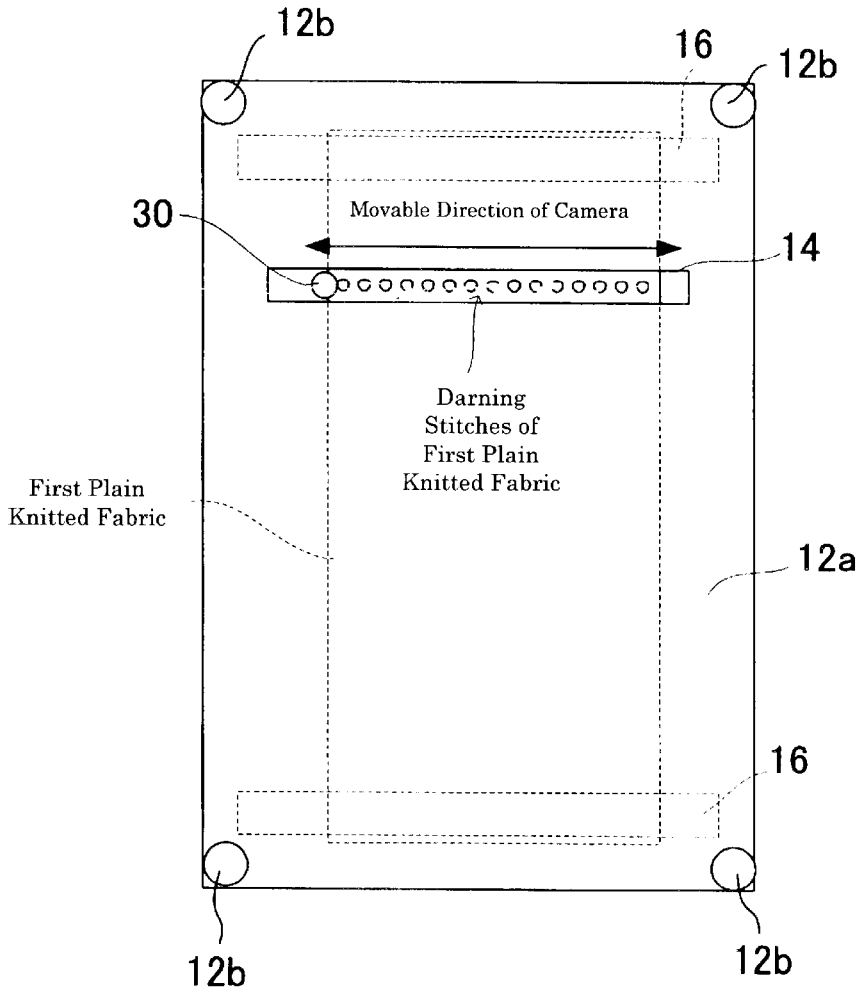
FIG. 12 is an illustration showing an image of the darning stitch of the first plain knitted fabric being picked up in another preferred embodiment of the present invention.

In this preferred embodiment, all of the darning stitches of the first plain knitted fabric and of the second plain knitted fabric are preferably obtained at one time. Alternatively, the camera may be arranged to obtain zoomed-in images of each of the darning stitches, and the image obtaining may be performed in a scanning manner while moving the camera in the direction in which the darning stitches are provided in a row, as shown in FIG. 12. The movement of the camera may be performed either continuously or intermittently.

In this preferred embodiment, the sewing machine needle 32 moves to the location of the darning stitch of the first plain knitted fabric to be linked next in step S11 Alternatively, the sewing machine needle 32 may simply, move one stitch distance of the average interval distance between the darning stitches in the direction in which the darning stitches are provided in a row.

In this preferred embodiment, the slit 14 is maintained in the same location as it is when obtaining an image of the darning stitch of the second plain knitted fabric. However, the slit may be constructed such that the first plain knitted fabric located below the second darning stitch cannot be seen through when obtaining an image of the second darning stitch, e.g. by installing a plate inside the slit 14 which is controlled to be moved out and in by the control apparatus 26, by installing a plate on the underside of the top plate 12*a* which is controlled to be moved out and in by the control apparatus 26, or by installing a plate between the top plate 12*a* and the holding fixture 18 which is controlled to be moved out and in by the control apparatus 26. These plates preferably have a surface-emitting light source, such that an image of the darning stitch is clearly obtained, utilizing a light emitted through the plain knitted fabric.

Figure 13:
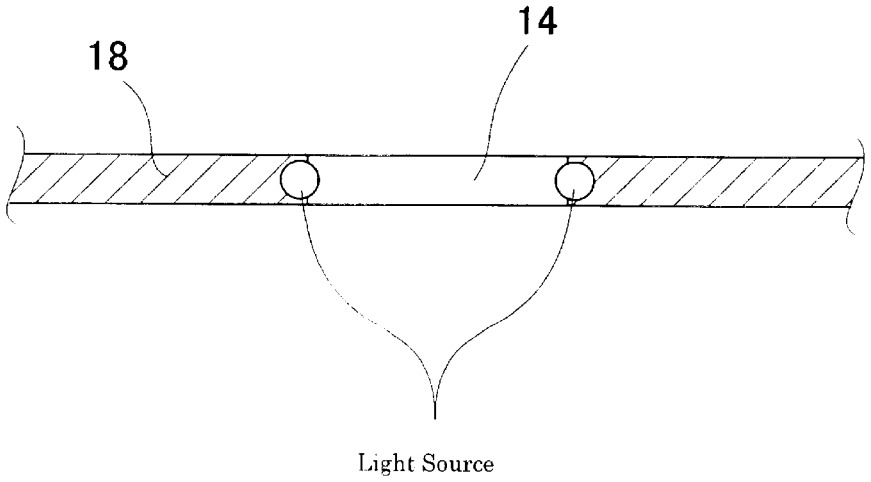
FIG. 13 is a sectional illustration showing the periphery of a slit of the holding fixture in another preferred embodiment of the present invention.

In the preceding paragraph, a construction is described in which the slit 14 is shut such that the first plain knitted fabric cannot be seen through while obtaining an image of the darning stitch. Alternatively, a light source such as a plurality of high-intensity LEDs or a CRT (cathode ray tube) may be provided inside the slit 14 to reduce the volume of light reflected by the first plain knitted fabric and of the light emitting through the first plain knitted fabric which enters into the camera 36, as shown in FIG. 13. Alternatively, a light may be emitted from an optional light source provided below the top plate 12*a*, such that image-pickup is performed utilizing the light that is emitted through the slits 20 and 14. In this case, it is necessary to use, when obtaining an image, a light source having an illuminating power such that the image of the first plain knitted fabric becomes unclear.

In this preferred embodiment, when moving the holding fixture 18 above the top plate 12*a*, the holding fixture 18 is moved in a state where the holding fixture 18 and the first plain knitted fabric are not substantially in contact, such that the location of the fixed darning stitch of the plain knitted fabric is not altered. Alternatively, a narrow clearance may be provided between the holding fixture 18 and the first plain knitted fabric to prevent them from contacting each other. This clearance is preferably as narrow as possible to enable the sewing machine needle 32 to pierce through the darning stitches of the first and second plain knitted fabrics easily when linking is performed.

Figure 14:
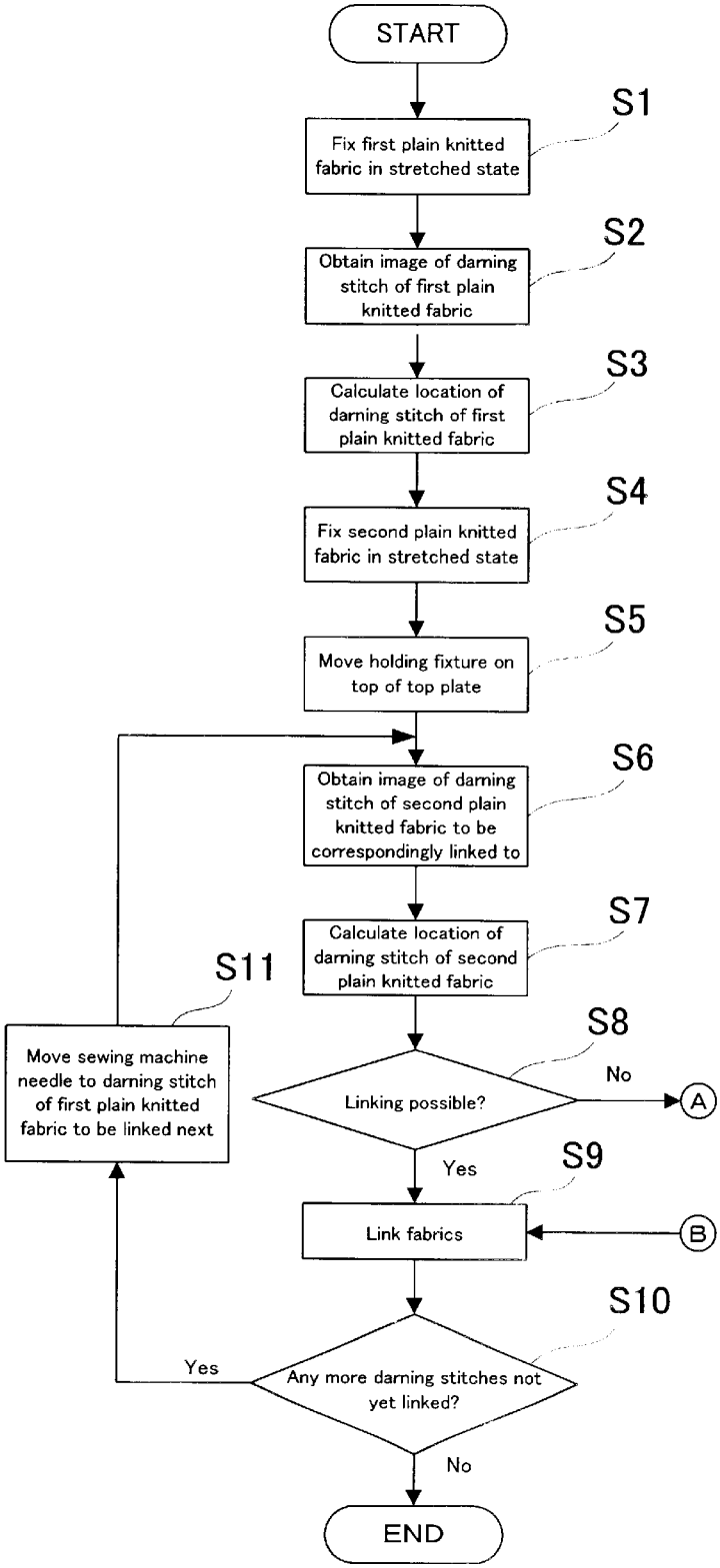
FIG. 14 is a flowchart showing another flow of operations in this preferred embodiment of the present invention.
Figure 15:
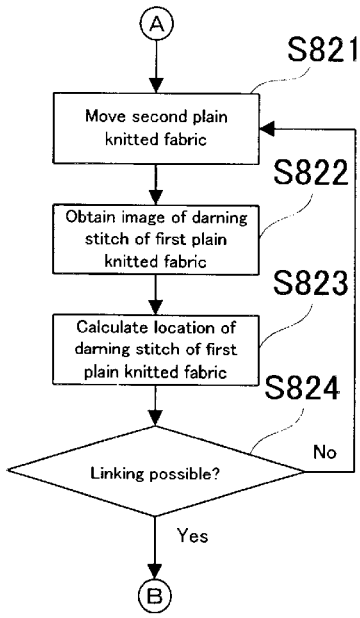
FIG. 15 is a flowchart showing a portion of the other flow of operations in this preferred embodiment of the present invention.

In this preferred embodiment, the step of obtaining the image of the darning stitch of the first plain knitted fabric and the step of calculating the location of the darning stitch are conducted only once. However, it is also possible to repeat the step of obtaining the image of the darning stitch of the first plain knitted fabric and the step of calculating the location of the darning stitch a plurality of times, as shown in FIGS. 14 and 15. These operations assume that the first plain knitted fabric is pulled and moved by the second plain knitted fabric, when the holding fixture 18 is moved after the first plain knitted fabric and the second plain knitted fabric have been linked by one or more stitches.

Figure 16:
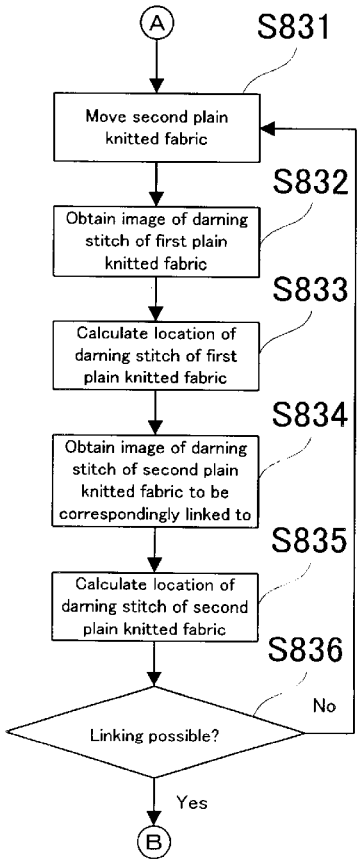
FIG. 16 is a flowchart showing another portion of another flow of operations in this preferred embodiment of the present invention.

In various preferred embodiments of the present invention, it is also possible to repeat the step of calculating the locations of the darning stitch of the first plain knitted fabric and of the darning stitch of the second plain knitted fabric a plurality of times, as shown in FIGS. 14 and 16. These operations assume that the first plain knitted fabric and the second plain knitted fabric are moved by pulling each other, when the holding fixture 18 is moved after the first plain knitted fabric and the second plain knitted fabric have been linked by one or more stitches.

When calculating the location of the darning stitch of the first plain knitted fabric again after the first plain knitted fabric has been fixed to the top plate 12*a*, as indicated in the flowchart shown in FIGS. 14 to 16, a light source such as an EL plate (electroluminescence plate) or a light guiding plate are preferably interposed between the holding fixture 18 and the first plain knitted fabric whereby the process of obtaining an image is performed. The obtaining of an image also may be performed utilizing the light of the light source inside the slit 14, as shown in FIG. 13, or it may be performed by illuminating the first plain knitted fabric from the outside.

Figure 17:
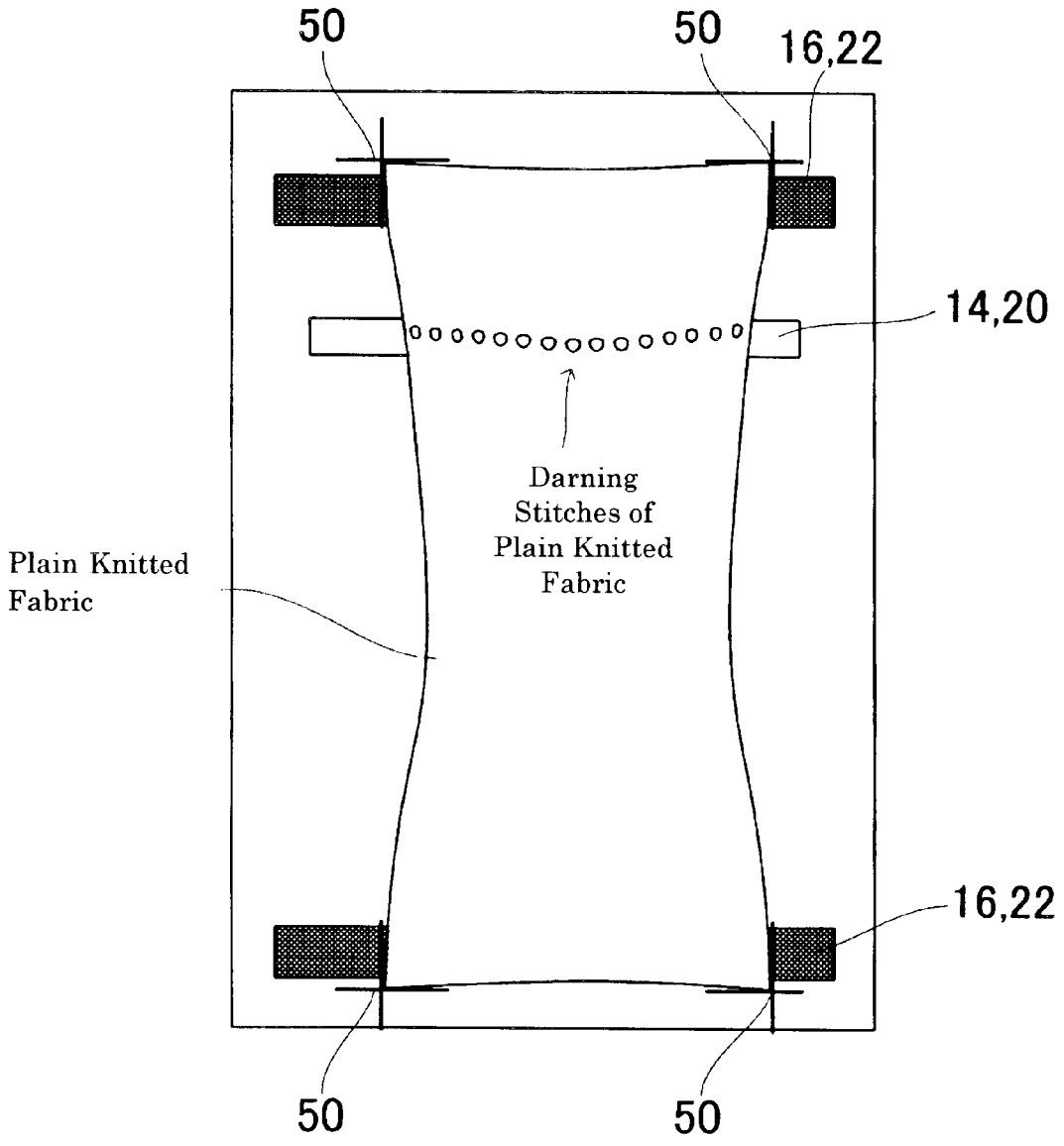
FIG. 17 is an illustration showing the plain knitted fabric being fixed while being stretched.
Figure 18:
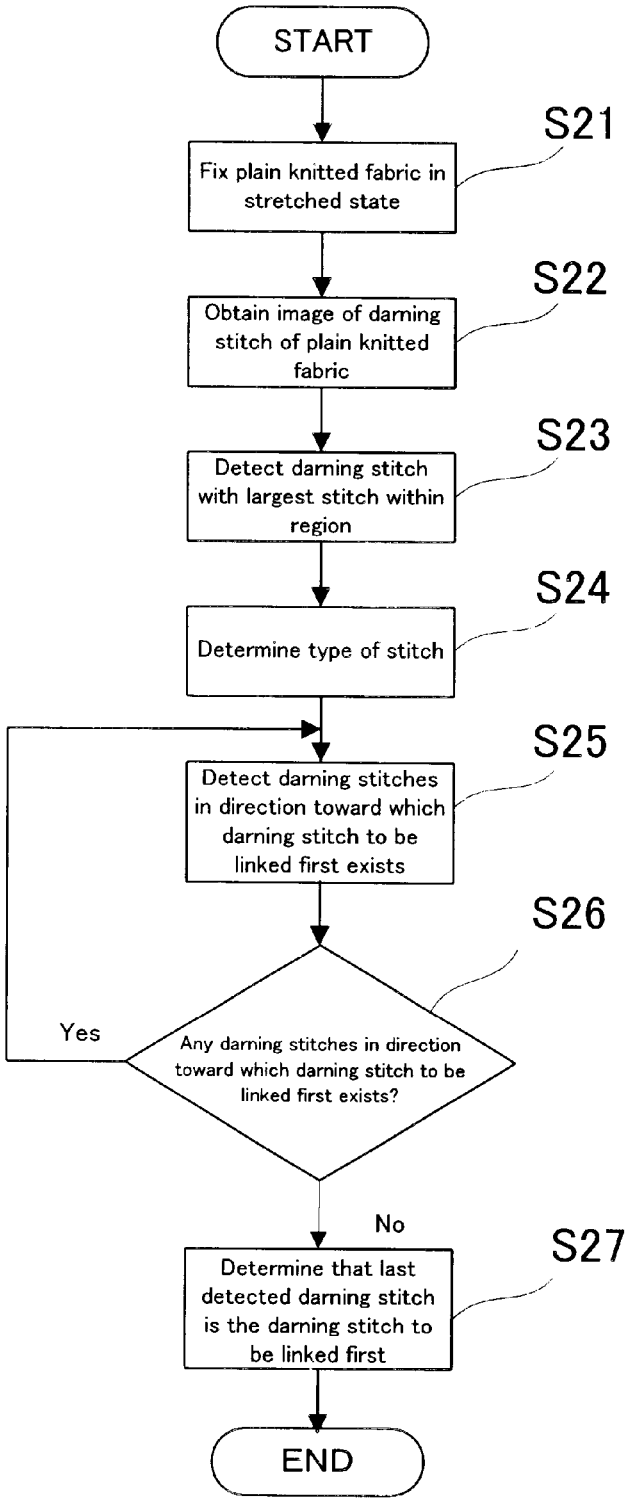
FIG. 18 is a flowchart showing a flow of operations for calculating the location of the darning stitch to be linked first.
Figure 19:
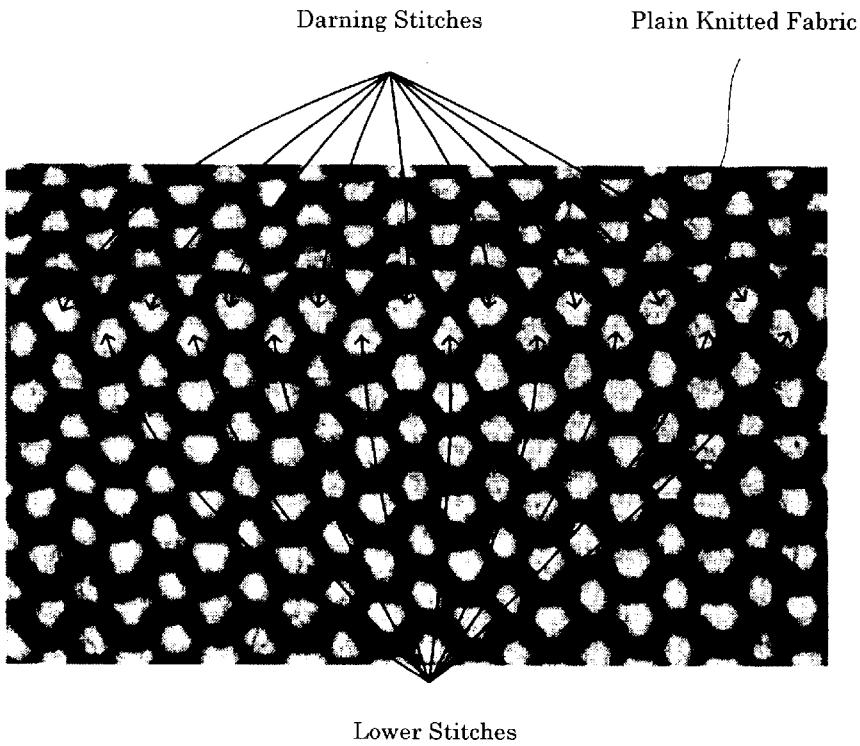
FIG. 19 is a view showing the darning stitches and lower stitches.

In this preferred embodiment, the location of the darning stitch of the plain knitted fabric is detected by methods similar to those disclosed in Japanese Patent Laid-Open Publication No. Hei 11-207061 or No. Hei 11-207062, however, other image analyzing methods may also be utilized. Particularly, since the darning stitch to be linked first is provided near the end of the plain knitted fabric, the darning stitch is susceptible to deformation caused by a shrinking force of the plain knitted fabric when the first plain knitted fabric or the second plain knitted fabric is fixed to the holding fixture 18 or the top plate 12*a*, as shown in FIG. 17, which makes detection of the location of the darning stitch difficult. Hence, a special method is preferably used to detect the darning stitch.

A method for calculating the location of the darning stitch to be linked first will be described with reference to FIGS. 18 through 22.

In step S21, a plain knitted fabric is fixed at a desired position in a stretched state, as shown in FIG. 17. The desired position is a location of the darning stitch to be linked first is arranged within a randomly defined region. In order to fix the plain knitted fabric at the desired position, a mark 50 is provided on the holding fixture 18 or the top plate 12*a*, and the plain knitted fabric is fixed onto the surface fastener 16 or the surface fastener 22, with reference to the mark 50.

Then, in step S22, a multiple tone image including an image of the darning stitches arranged on the slit 14 or the slit 20 is obtained by the camera 30 or the camera 36.

Figure 20:
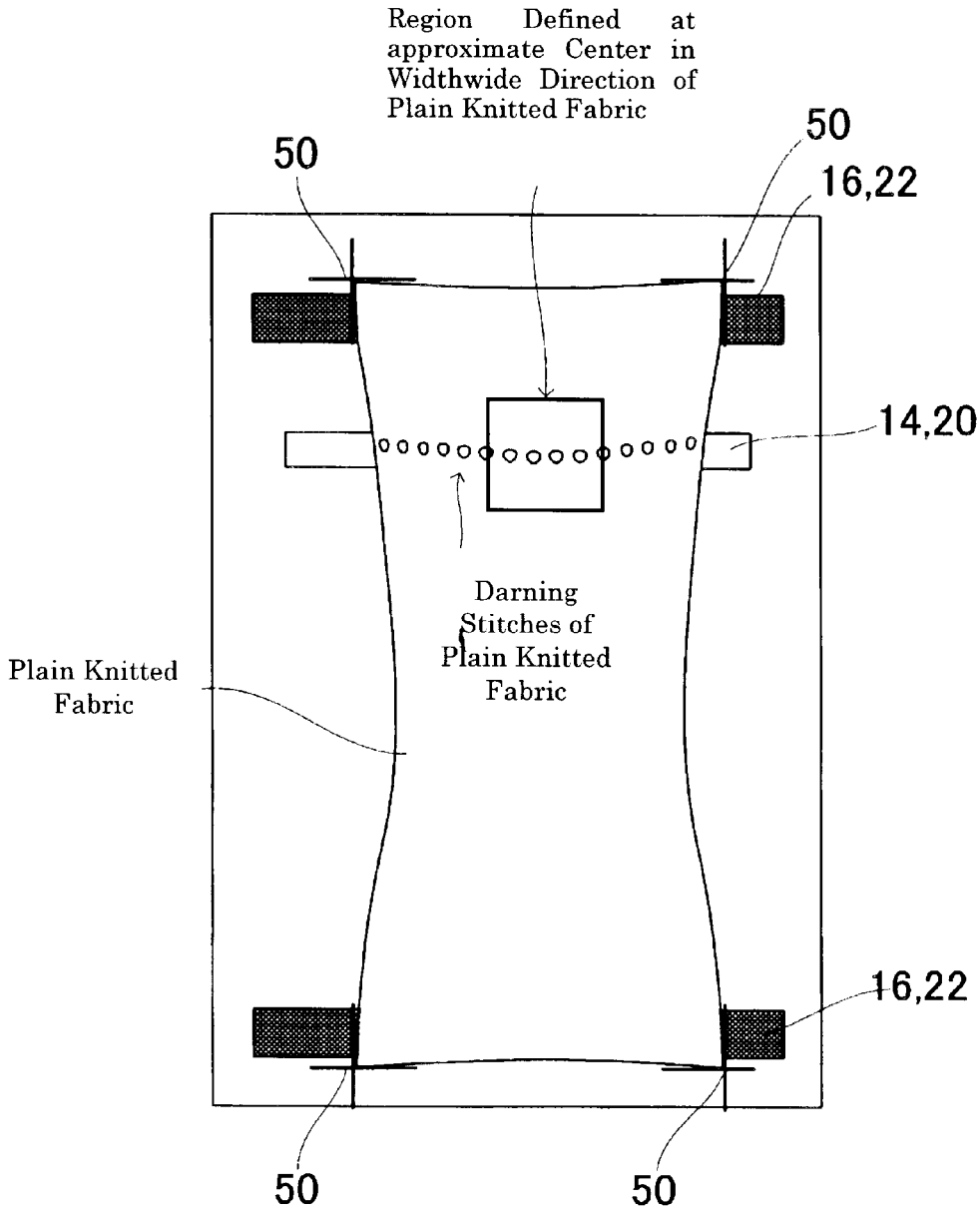
FIG. 20 is an illustration showing the plain knitted fabric being fixed to the top plate.

In step S23, the obtained multiple tone image is sent to the image processing system 28, and a darning stitch or a lower stitch having the largest stitch within a region defined approximately at the center in the widthwise direction of the plain knitted fabric, is detected. The "lower stitch" mentioned here indicates a stitch that has approximately the same size as the darning stitch consequently by forming the darning stitch. The region defined at the approximate center in the widthwise direction of the plain knitted fabric is defined such that the darning stitch and the lower stitch are included within that region, as shown in FIG. 20. The reason that this region is defined at the approximate center in the widthwise direction of the plain knitted fabric is that the darning stitches at the approximate center of the plain knitted fabric are uniformly stretched as compared with those near the end and are uniformly lined up. Thus, the darning stitches and the lower stitches provided in this region are easily detected. Where large stitches other than the darning stitches and the lower stitches provided on the plain knitted fabric, such as a lace pattern, the region at the approximate center in the widthwise direction of the plain knitted fabric is defined such that the region does not include those patterns.

In step S24, a decision is made whether the type of the stitch detected in step S23 is a darning stitch or a lower stitch. According to this decision, it is decided that the stitch detected in step S23 is a lower stitch when a large stitch exists on the upper side, at a location spaced one-half a pitch of the darning stitch away from the stitch detected in step S23, in the direction of the darning stitch to be linked first. On the contrary, it is decided that the detected stitch is a darning stitch when a large stitch exists on the lower side, at a location spaced one-half a pitch of the darning stitch away from the stitch detected in step S23, in the direction of the darning stitch to be linked first.

Figure 21:
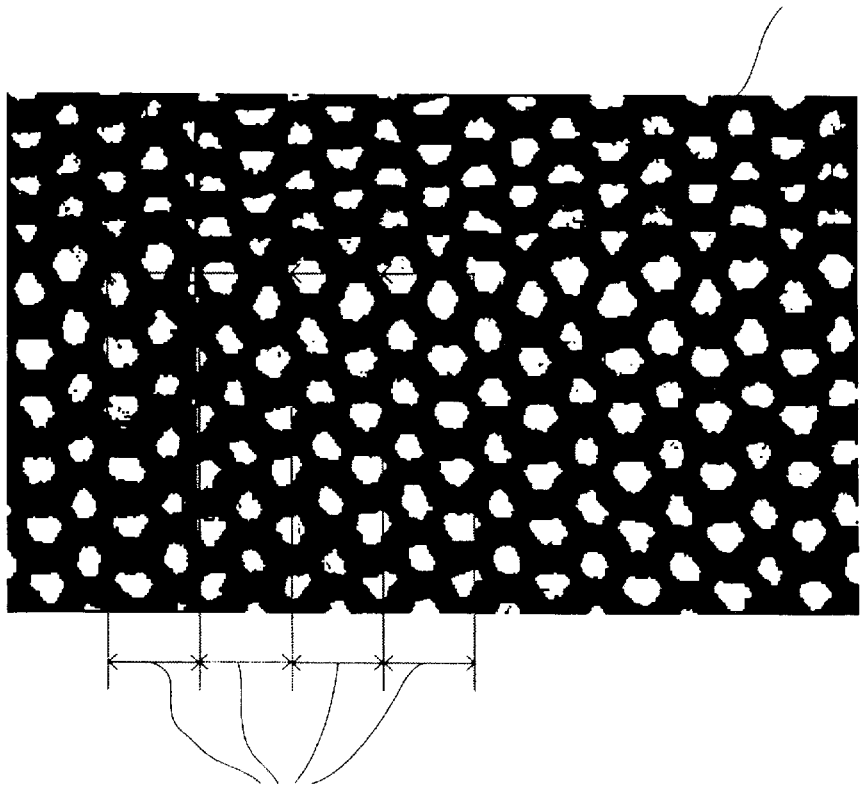
FIG. 21 is an illustration showing a method for detecting the darning stitches.
Figure 22:
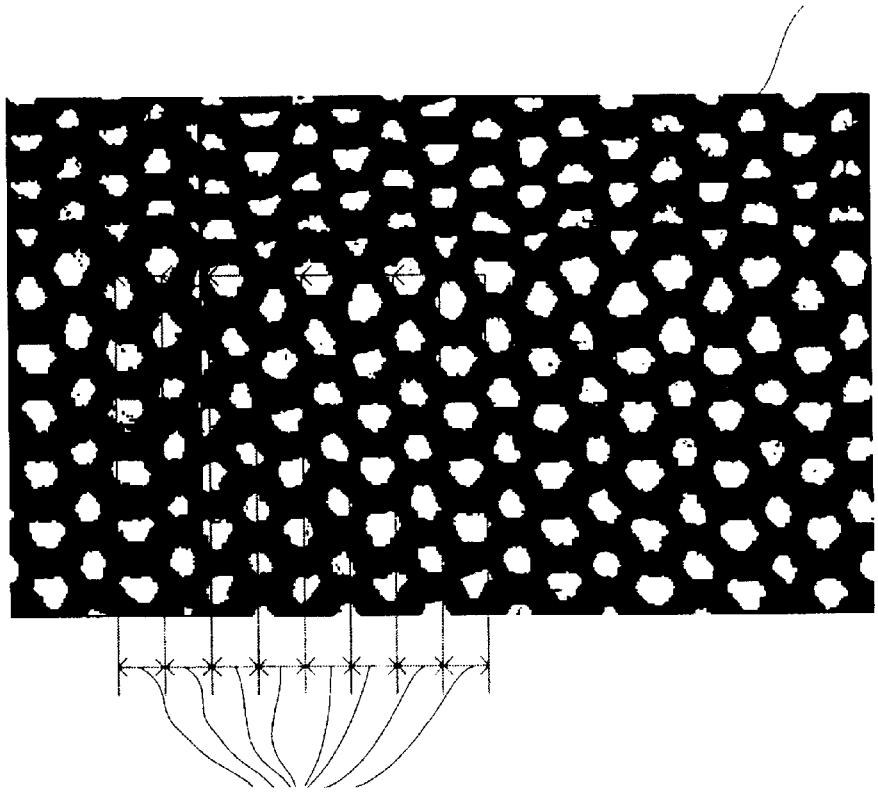
FIG. 22 is an illustration showing another method for detecting the darning stitches.

In step S25, the darning stitches are detected in the direction toward which the darning stitch to be linked first exists, starting from the stitch detected in step S23. For detecting methods of the darning stitch, a method by which the darning stitch is detected after moving one pitch of the darning stitch, as shown in FIG. 21, or a method by which the darning stitch and the lower stitch are detected alternately after moving half a pitch of the darning stitch, as shown in FIG. 22 is provided. When the detected stitch is a lower stitch in step S24, the present step is conducted, after the darning stitch located half a pitch sideways and on the upper side of the lower stitch is set to be the first reference point.

In step S26, it is decided whether or not a darning stitch exists in the direction toward which the darning stitch to be linked first exists, and when no additional darning stitches exist in that direction, the last detected darning stitch is recognized as the darning stitch to be linked first.

With the above-mentioned method, the darning stitch to be linked first is accurately determined. The precision of the linking operation is further improved by applying this method to the steps of detecting the darning stitch to be linked first (steps S1 through S3, or step S4, or steps S6 and S7 in the first repetition), indicated in the flowcharts of FIG. 4 or FIG. 14.

A faster and more accurate linking operation is possible, when the location of each of the darning stitches detected in step S25 is used as a reference data in moving the sewing machine needle.

With the present invention, a method and an apparatus are provided for linking plain knitted fabrics which requires greatly reduced mounting space and which enables accurate and effective linking of fabrics, regardless of the type of plain knitted fabric.

While preferred embodiments of the invention have been disclosed, various modes of carrying out the principles disclosed herein are contemplated as being within the scope of the following claims. Therefore, it is understood that the scope of the present invention is not to be limited except as otherwise set forth in the claims.

What is claimed is:

1. A method for linking plain knitted fabrics comprising the steps of:

fixing a first plain knitted fabric in a stretched state;

obtaining an image including an image of a darning stitch of the first plain knitted fabric in the stretched state;

calculating a location of the darning stitch of the first plain knitted fabric from the obtained image including the image of the darning stitch of the first plain knitted fabric in the stretched state;

holding a second plain knitted fabric in a stretched state;

obtaining an image including an image of a darning stitch of the second plain knitted fabric in the stretched state;

calculating a location of the darning stitch of the second plain knitted fabric to be linked to the darning stitch of the first plain knitted fabric, from the obtained image including the image of the darning stitch of the second plain knitted fabric in the stretched state;

moving the first plain knitted fabric and the second plain knitted fabric relative to each other to align the darning stitch of the second plain knitted fabric and the darning stitch of the first plain knitted fabric with each other;

moving a sewing machine needle of a sewing machine mechanism to the location of the darning stitch of the first plain knitted fabric; and linking together the darning stitch of the first plain knitted fabric and the darning stitch of the second plain knitted fabric with the sewing machine needle.

2. A method for linking plain knitted fabrics according to claim 1, wherein in the step of obtaining the image including the image of the darning stitch of the first plain knitted fabric, an image including a plurality of darning stitches of the first plain knitted fabric is obtained, and in the step of calculating the location of the darning stitch of the first plain knitted fabric from the obtained image, locations of the plurality of the obtained darning stitches of the first plain knitted fabric are calculated.

3. A method for linking plain knitted fabrics according to claim 2, wherein in the step of obtaining the image including the image of the darning stitch of the first plain knitted fabric, the image including a plurality of darning stitches of the first plain knitted fabric is obtained by a moving image obtaining device.

4. A method for linking plain knitted fabrics according to claim 1, wherein the step of calculating the location of the darning stitch of the first plain knitted fabric from the obtained image including the image of the darning stitch of the first plain knitted fabric in the stretched state and the step of calculating the location of the darning stitch of the second plain knitted fabric to be correspondingly linked to from the obtained image including the image of the darning stitch of the second plain knitted fabric in the stretched state, include the step of detecting a darning stitch to be linked first.

5. A method for linking plain knitted fabrics according to claim 4, wherein the step of detecting the darning stitch to be linked first includes the steps of:

detecting a darning stitch or a lower stitch in a region where the darning stitches are uniformly arranged;

detecting darning stitches in sequence in a direction toward the darning stitch to be linked first relative to the location of the detected darning stitch or lower stitch; and determining whether or not the detected darning stitch is the darning stitch to be linked first.

6. A method for linking plain knitted fabrics according to claim 1, wherein the method further comprises the step of moving the sewing machine needle of the sewing machine mechanism by one stitch of the darning stitch in a direction in which a plurality of darning stitches is provided in a row, and the following steps are performed repeatedly:

obtaining the image including the image of the darning stitch of the second plain knitted fabric;

calculating the location of the darning stitch of the second plain knitted fabric from the obtained image;

moving the second plain knitted fabric to align the darning stitch of the second plain knitted fabric and the darning stitch of the first plain knitted fabric with each other;

moving a sewing machine needle of a sewing machine mechanism to the location of the darning stitch of the first plain knitted fabric to be linked with;

linking the darning stitch of the first plain knitted fabric and the darning stitch of the second plain knitted fabric together by the sewing machine needle; and moving the sewing machine needle of the sewing machine mechanism by one stitch of the darning stitch in the direction in which the plurality of darning stitches are provided in a row.

7. A method for linking plain knitted fabrics according to claim 6, wherein in the step of moving the sewing machine needle of the sewing machine mechanism by one stitch of the darning stitch in the direction in which the plurality of darning stitches are provided in a row, the sewing machine needle is moved to a location where the darning stitch of the first plain knitted fabric to be linked with is actually located based on data calculated in the step of calculating the location of the darning stitch of the first plain knitted fabric.

8. A method for linking plain knitted fabrics according to claim 6, wherein the step of calculating the location of the darning stitch of the first plain knitted fabric from the obtained image and the step of calculating the location of the darning stitch of the second plain knitted fabric to be correspondingly linked to from the obtained image include the step of detecting a darning stitch to be linked first.

9. A method for linking plain knitted fabrics according to claim 8, wherein the step of detecting the darning stitch to be linked first includes the steps of:

detecting a darning stitch or a lower stitch in a region where the darning stitches are uniformly arranged;

detecting darning stitches in sequence in a direction toward the darning stitch to be linked first relative to the location of the detected darning stitch or lower stitch; and determining whether or not the detected darning stitch is the darning stitch to be linked first.

10. An apparatus for linking plain knitted fabrics comprising:

a fixing device fixing a first plain knitted fabric in a stretched state;

a first image obtaining device for obtaining an image including an image of a darning stitch of the first plain knitted fabric in the stretched state;

a holding fixture for holding a second plain knitted fabric in a stretched state;

a second image obtaining device for obtaining an image including an image of a darning stitch of the second plain knitted fabric in the stretched state;

an image processing system for calculating a location of the darning stitch of the first plain knitted fabric and a location of the darning stitch of the second plain knitted fabric from the images picked up by the first image obtaining device and the second image obtaining device;

a controller for locating a holding fixture controlling the movement of the holding fixture such that the location of the darning stitch of the second plain knitted fabric is aligned with the darning stitch of the first plain knitted fabric; and a sewing machine mechanism provided with a control apparatus for locating a sewing machine needle which controls the sewing machine needle to move to the location of the darning stitch of the first plain knitted fabric to be linked with.

11. An apparatus for linking plain knitted fabrics according to claim 10, wherein the first image obtaining device for obtaining the image including the image of the darning stitch of the first plain knitted fabric obtains an image including an image of a plurality of darning stitches of the first plain knitted fabric, and the image processing system for calculating the location of the darning stitch of the first plain knitted fabric about to be linked from the obtained image calculates the locations of the plurality of darning stitches of the first plain knitted fabric.

12. An apparatus for linking plain knitted fabrics according to claim 11, wherein the apparatus comprises a moving mechanism for moving the first image obtaining device, and the first image obtaining device for obtaining the image including the image of the darning stitch of the first plain knitted fabric picks up the image including the image of the plurality of darning stitches of the first plain knitted fabric while being moved by the moving mechanism.

13. An apparatus for linking plain knitted fabrics according to claim 10, wherein the control apparatus for locating the sewing machine needle controls the sewing machine needle to move to the location of the darning stitch of the first plain knitted fabric to be linked next, after completing a linking of one stitch of the darning stitches.

14. An apparatus for linking plain knitted fabrics according to claim 13, wherein the second image obtaining device moves along with the movement of the sewing machine needle.

* * * * *